US009668305B2

(12) United States Patent
Garcia Jimenez et al.

(10) Patent No.: US 9,668,305 B2
(45) Date of Patent: May 30, 2017

(54) HOB HAVING AT LEAST ONE INDUCTOR, AT LEAST ONE INVERTER AND A SWITCHING APPARATUS

(75) Inventors: Jose-Ramon Garcia Jimenez, Saragossa (ES); Ignacio Garde Aranda, Saragossa (ES); Pablo Jesus Hernandez Blasco, Cuarte de Huerva (ES); Fernando Monterde Aznar, Saragossa (ES); Daniel Palacios Tomas, Saragossa (ES); Ramon Peinado Adiego, Saragossa (ES)

(73) Assignee: BSH Hausgeräte GmbH, Munich (DE)

( * ) Notice: Subject to any disclaimer, the term of this patent is extended or adjusted under 35 U.S.C. 154(b) by 1280 days.

(21) Appl. No.: 13/131,911

(22) PCT Filed: Dec. 7, 2009

(86) PCT No.: PCT/EP2009/066468

§ 371 (c)(1),
(2), (4) Date: May 31, 2011

(87) PCT Pub. No.: WO2013/069788

PCT Pub. Date: Jun. 24, 2010

(65) Prior Publication Data

US 2011/0233199 A1 Sep. 29, 2011

(30) Foreign Application Priority Data

Dec. 19, 2008 (ES) ..... 200803711

(51) Int. Cl.
*H05B 6/12* (2006.01)
*H05B 6/02* (2006.01)
(Continued)

(52) U.S. Cl.
CPC ..... *H05B 6/065* (2013.01); *H05B 2213/03* (2013.01); *H05B 2213/05* (2013.01)

(58) Field of Classification Search
CPC . H05B 6/02; H05B 6/06; H05B 6/065; H05B 6/10; H05B 6/12; H05B 6/1209
(Continued)

(56) References Cited

U.S. PATENT DOCUMENTS 4,112,287 A * 9/1978 Oates et al. ..... 219/626
4,426,564 A * 1/1984 Steigerwald et al. ..... 219/624
(Continued)

FOREIGN PATENT DOCUMENTS

EP 0498735 B2 4/1999
WO 2007042316 A1 4/2007

OTHER PUBLICATIONS

English translation of EP 0498735 to Gaspard published Apr. 21, 1999.*

(Continued)

*Primary Examiner* — Michael Laflame, Jr.
(74) *Attorney, Agent, or Firm* — Michael E. Tschupp; Andre Pallapies

(57) ABSTRACT

A hob having at least one inductor, at least one inverter, a switching apparatus and a detection circuit for detection of cooking utensils. The switching apparatus is arranged in a circuit between the inductor and the inverter and switchable between a first switch position in which a connection between the inverter and the inductor is established and a second switch position in which the connection between the inverter and the inductor is interrupted. In order to allow an energy-saving detection mode, the switching apparatus is connected to the detection circuit such that the switching apparatus connects the inductor to the detection circuit when it is in the second switch position.

17 Claims, 2 Drawing Sheets

(51) Int. Cl.
*H05B 6/06* (2006.01)
*H05B 6/10* (2006.01)

(58) Field of Classification Search
USPC ..... 99/451; 219/620, 621, 626, 665, 518, 219/668, 600, 625
See application file for complete search history.

(56) References Cited

U.S. PATENT DOCUMENTS

| | | | | |
|---|---|---|---|---|
| 5,571,815 | A | 11/1996 | Schaper et al. | |
| 5,808,280 | A | 9/1998 | Gaspard | |
| 6,242,721 | B1 * | 6/2001 | Borrmann et al. | 219/518 |
| 6,259,069 | B1 * | 7/2001 | Schotten et al. | 219/447.1 |
| 7,157,674 | B2 * | 1/2007 | Miyauchi et al. | 219/621 |
| 2004/0016747 | A1 * | 1/2004 | Larson et al. | 219/492 |
| 2004/0144769 | A1 | 7/2004 | Pastore | |
| 2006/0289489 | A1 * | 12/2006 | Wang | 219/622 |
| 2007/0278215 | A1 * | 12/2007 | Schilling et al. | 219/622 |

OTHER PUBLICATIONS

International Search Report PCT/EP2009/066468.
National Search Report ES P200803711.

* cited by examiner

HOB HAVING AT LEAST ONE INDUCTOR, AT LEAST ONE INVERTER AND A SWITCHING APPARATUS

BACKGROUND OF THE INVENTION

The invention relates to a hob having at least one inductor, at least one inverter and a switching apparatus.

An induction hob having a plurality of inductors, with one inverter per inductor, an electronic switching apparatus and a detection circuit for detection of cooking utensils, is known from DE 42 08 254 A1. The switching apparatus opens and closes a circuit between the inductor and the inverter, so that, when the switching apparatus is in a first switch position, it makes a connection between the inverter and the inductor and, when it is a second switch position, it interrupts the connection between the inverter and the inductor.

In order to detect cooking utensils, a microcomputer initiates the closing of one of the switches in the switching apparatus, in order to connect one of the inductors during a semi-oscillation of the heater voltage to the inverter assigned to this inductor. Any attenuation in the oscillation system is determined from a voltage amplitude at a sampling point or from a drop in the voltage. The presence or existence of a cooking utensil is indicated by sufficient attenuation. The inductor is automatically activated following the detection of a cooking utensil.

The continued supply of current at full amplitude to the inductor during standby operation consumes a large amount of energy compared to pan detection devices that use separate measurement sensors operated with a low measuring voltage. However, the provision of separate measurement sensors is costly and time-consuming compared to the use of inductors both as heating elements and as sensors.

BRIEF SUMMARY OF THE INVENTION

The object underlying the invention is therefore in particular to equip a hob of this type with an energy-saving pan detection device, without the need to provide additional sensors.

The invention relates in particular to a hob having at least one inductor, at least one inverter, a switching apparatus and a detection circuit for detection of cooking utensils. The switching apparatus is arranged in a circuit between the inductor and the inverter, such that, when the switching apparatus is in a first switch position, it makes a connection between the inverter and the inductor and, when it is in at least one second switch position, it interrupts the connection between the inverter and the inductor.

It is proposed that the switching apparatus be connected to the detection circuit such that the switching apparatus, when it is in at least one second switch position, connects the inductor to the detection circuit. Thus it is possible, by simple constructional means, for the inductor to be linked to the detection circuit, which can then use the inductor as an inductive sensor. In particular, the detection circuit can also supply a low-voltage measurement current into the inductor, so that energy-saving measurement in standby mode is possible. This enables energy-saving detection to be operated, which—with regard to operating costs—can rival hobs equipped with separate sensors.

The two aforementioned switch positions may be supplemented by further switch positions of the switching apparatus, which may correspond to respective further functions of the hob. For example, the switching apparatus may have switch positions in which an inductor is simultaneously connected to a plurality of inverters or an inverter simultaneously operates a plurality of inductors.

In a development of the invention, it is proposed that the switching apparatus comprises at least one electromechanical relay with two output terminals, the first output terminal being connected to the inverter and the second output terminal being connected to the detection circuit. This enables a particularly robust design to be achieved for the invention. Compared to implementation of the switching apparatus as an arrangement of semiconductor relays, in which two semiconductor switches would need to be used for each switching unit, costs can be saved and reliable switching guaranteed even with very strong heating currents. The features of an electromechanical double pole double throw relay are particularly advantageous if the strengths of measurement current and heating current differ by one or more orders of magnitude.

If the hob comprises a plurality of inductors, which may be arranged in particular in the form of a grid or matrix, the advantages of the invention can be particularly brought to bear. Here, too, the connections between the individual inductors with the inverters respectively assigned to them are opened or closed via the switching apparatus.

In a particularly advantageous embodiment of the invention, the detection circuit can form an oscillating circuit with the inductor. The presence or absence of cooking utensils may be determined on the basis of a resonance frequency of the oscillating circuit. Targeted control can be facilitated if the hob comprises a control unit for reading out from the detection circuit and/or for operating the switching apparatus.

A particularly flexible, modular design may be achieved if a switch in the switching apparatus that is assigned to the inductor is directly connected to the inductor. The inductor may comprise, in particular, an inductor coil, an inductor support and a screening element. These elements may be combined to form a compact inductor module, which—according to the invention—may also comprise switches, in particular ones embodied as electromechanical relay switches. Cables for making a connection with the inverter and with the detection circuit can be plugged directly into two different output terminals of the inductor module or connected to them in a different way, for example by means of an appropriate multipolar plug. The two output terminals are connected to the two output terminals of the switch, the input of which is in turn connected to the inductor.

Further advantages will emerge from the following description with diagrams. The diagrams show exemplary embodiments of the invention. The diagrams, the description and the claims contain numerous features in combination. A person skilled in the art will also consider the features individually where expedient and put them together into other feasible combinations.

BRIEF DESCRIPTION OF THE DRAWINGS

In the diagrams.

DETAILED DESCRIPTION OF EXEMPLARY EMBODIMENTS OF THE PRESENT INVENTION

Figure 1:
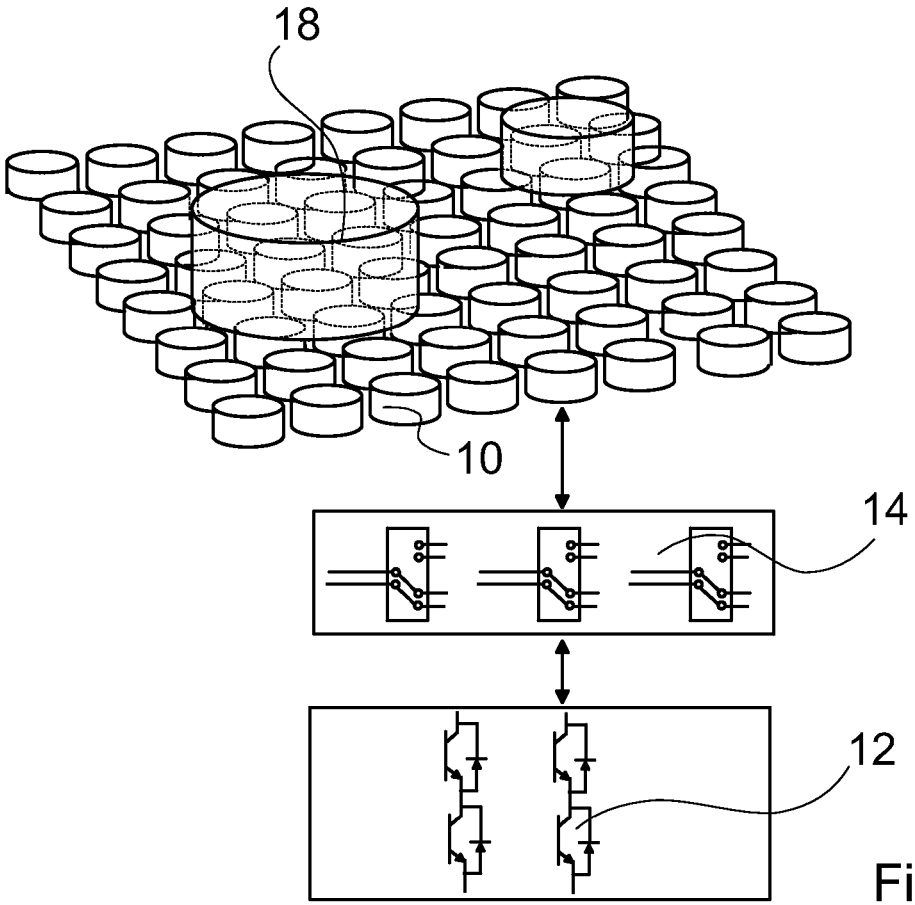
FIG. 1 is a schematic illustration of an induction hob with inductors arranged in a grid pattern, a switching apparatus and a plurality of inverters.

FIG. 1 shows an induction hob of the matrix type, having a plurality of inductors 10 arranged in a grid pattern. The inductors 10 form a rectangular grid and can be divided over several modules, each of which is supplied from different power supply units (not shown). The inductors 10 may be activated and deactivated selectively and individually, for which purpose a switching apparatus 14 may make or interrupt a connection between the inductors 10 and an inverter 12 assigned to the respective inductor 10.

In a first switch position of the switching apparatus 14 the inverter 12 is connected to the inductor 10, so that an alternating current with a frequency of a few kilohertz up to a maximum of approx. 75 or 100 kilohertz and operated by a voltage amplitude of several hundred volts flows through the inductors 10. The inductors 10 generate a strong, high-frequency magnetic field, which partially permeates the base of a cooking utensil 18 when a cooking utensil 18 with a ferromagnetic base is placed on the induction hob. The alternating magnetic field causes eddy currents, which heat up the base, to be generated in a ferromagnetic base of the cooking utensil 18.

FIG. 1 is a schematic diagram which does not reflect the actual arrangement of the inductors 10 with regard to the switching apparatus 14 and the inverter 12. The switching apparatus 14 may be mounted on a common board with the inverters 12, or form a structurally separate unit.

Figure 2:
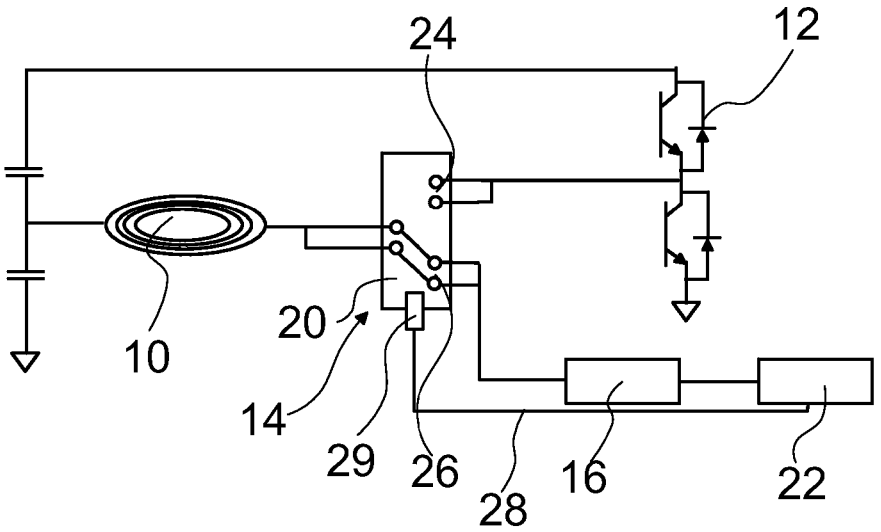
FIG. 2 is a schematic illustration of an inductor with a switching apparatus which connects the inductor to an inverter when in a first switch position, and connects the inductor to a detection circuit when in a second switch position.

FIG. 2 schematically shows a random inductor 10 of the induction hob from FIG. 1 with the inverter 12 assigned to this inductor 10 and a detection circuit 16. The detection circuit 16 can also be mounted with the switching apparatus 14 and/or the inverters 12 on a common board, or alternately be provided as separate modules.

A switching element of the switching apparatus 14, embodied as an electromechanical relay 20, is arranged between the inductor 10 and the inverter 12. The electromechanical relay 20 comprises two output terminals 24, 26. The first output terminal 24 is connected to the inverter 12 and the second output terminal 26 to the detection circuit 16. The electromechanical relay 20 is embodied as a "double pole double throw" (DPDT) relay with two parallel-switched working contacts. A control unit 22 reads out from the detection circuit 16 and is connected via a control cable 28 to the coil of an electromagnet 29 in the relay 20. The control unit 22 may be a microcontroller or a freely programmable arithmetic unit, which operates—in addition to the inductors 10, the switching apparatus 14 and the detection circuit 16—further electronic modules of the hob, for example a user interface with a display or the like. The result of the cooking utensil detection can then be shown on the display.

In the second switch position, in which the switch contacts of the relay 20 connect the second output terminal 26 of the relay 20 to the inductor 10, the inductor 10, with the detection circuit 16, forms a Colpitts oscillator in which two capacitors and the inductor 10 determine the oscillation frequency. The feedback necessary for the oscillation is generated via a voltage divider between the two capacitors (not shown).

The detection circuit 16 has a low-power alternating voltage applied to it, which generates an alternating measurement voltage of approx. 10 or 12 volts in the corresponding inductor 10 and results in measurement currents of a few milliamperes. The inductor 10 is used as a measuring probe in this operating state. The inductor 10 forms an oscillating circuit together with two capacitors. The placement of the cooking utensil 18 causes the inductivity of the overall system consisting of the inductor 10 and the cooking utensil 18 to be reduced compared to the inductivity of the free inductor 10, whereby the resonance frequency of the oscillating circuit is increased by approximately 10%. The detection circuit 16 or the control unit 22 measures the resonance frequency of this overall system and indicates the presence of the cooking utensil 18 from the increased resonance frequency.

Figure 3:
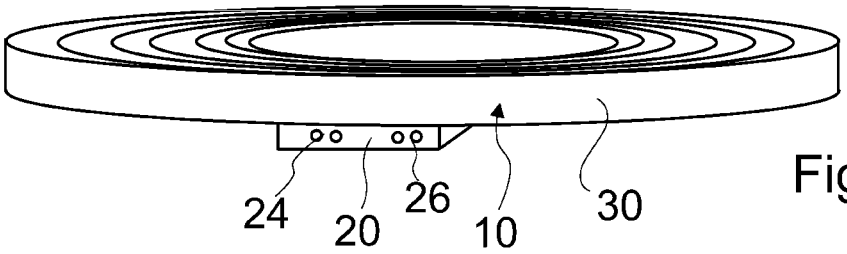
FIG. 3 shows an inductor module with an integrated switch of the switching apparatus.

FIG. 3 shows an inductor module comprising the inductor 10 and the switching element of the switching apparatus 14 embodied as a relay 20, in a conceivable embodiment of the invention. The relay 20 is attached directly to an underside of an inductor support 30, so that it forms a manageable module with the inductor 10. Corresponding connection cables to the inverters 12 and/or the detection circuit 16 can be plugged directly into the output terminals 24, 26 of the relay when the inductor module is connected.

REFERENCE CHARACTERS

10 Inductor
12 Inverter
14 Switching apparatus
16 Detection circuit
18 Cooking utensils
20 Relay
22 Control unit
24 Output terminal
26 Output terminal
28 Control cable
29 Electromagnet
30 Inductor support

The invention claimed is:

1. A hob, comprising:
at least one inductor;
at least one inverter;
a switching apparatus arranged in a circuit between the inductor and the inverter and switchable between a first switch position in which a connection between the inverter and the inductor is established and a second switch position in which the connection between the inverter and the inductor is interrupted; and
a detection circuit configured to detect a cooking utensil, said switching apparatus being connected to the detection circuit such that the switching apparatus connects the detection circuit to the inductor when the switching apparatus is in the second switch position and disconnects the detection circuit from the inductor when the switching apparatus is in the first switch position.

2. The hob of claim 1, wherein the switching apparatus comprises at least one electromechanical relay having at least two output terminals, the first output terminal being connected to the inverter and the second output terminal being connected to the detection circuit.

3. The hob of claim 1, further comprising a plurality of said inductors arranged in the form of a grid, said switching apparatus being configured to open and close connections between the individual inductors and the at least one inverter.

4. The hob of claim 1, wherein the detection circuit forms an oscillating circuit with the inductor, said oscillating circuit having a resonance frequency which is higher than a frequency of a heating current of the inductor.

5. The hob of claim 1, further comprising a control unit for reading out from the detection circuit.

6. The hob of claim 1, wherein the switching apparatus has a switch which is directly connected to the inductor.

7. The hob of claim 1, wherein a heating current transferred to the inductor in the first switch position is at least 1,000 times greater than a measurement current transferred to the inductor in the second switch position.

8. A cooktop comprising:

an inductor;

an inverter;

a detector; and a switch between the inductor and the inverter and having a first switch position which connects the inverter to the inductor and disconnects the detector from the inductor and a second position which connects the detector to the inductor and disconnects the inverter from the inductor.

9. The cooktop of claim 8, wherein the detector detects a cooking utensil.

10. The cooktop of claim 8, wherein the switch comprises an electromechanical relay with a first output terminal connected to the inverter and a second output terminal connected to the detector.

11. The cooktop of claim 8, further comprising a plurality of said inductors arranged in a grid and wherein said switch opens and closes connections between the individual inductors and the inverter.

12. The cooktop of claim 8, wherein the detector forms an oscillating circuit with the inductor having a resonance frequency that is higher than a resonance frequency of an oscillating circuit comprising the inductor and the inverter.

13. The cooktop of claim 8, further comprising a controller that receives a detection signal from the detector and that controls the switch.

14. The cooktop of claim 8, wherein the switch is directly connected to the inductor.

15. The cooktop of claim 14, further comprising an inductor support that integrally combines with the inductor and the switch to form an inductor module.

16. The cooktop of claim 8, wherein a current through the inductor when the switch is in the first switch position is at least one thousand times greater than a current through the inductor when the switch is in the second switch position.

17. The cooktop of claim 8, wherein the switch comprises a double pole throw relay.

* * * * *